US007402126B2

(12) United States Patent
Chang

(10) Patent No.: US 7,402,126 B2
(45) Date of Patent: Jul. 22, 2008

(54) ELLIPTICAL EXERCISER WITH ADJUSTABLE GUIDING RAILS

(76) Inventor: Huang-Tung Chang, P.O. Box 487, Chang-Hua City 500 (TW)

( * ) Notice: Subject to any disclaimer, the term of this patent is extended or adjusted under 35 U.S.C. 154(b) by 758 days.

(21) Appl. No.: 10/963,506

(22) Filed: Oct. 14, 2004

(65) Prior Publication Data

US 2006/0046902 A1 Mar. 2, 2006

(30) Foreign Application Priority Data

Sep. 1, 2004 (TW) ..... 93213918 U

(51) Int. Cl.
*A63B 22/00* (2006.01)
*A63B 69/18* (2006.01)
*A63B 22/04* (2006.01)

(52) U.S. Cl. ..... 482/52; 482/71; 482/51

(58) Field of Classification Search ..... 482/51–53, 482/57, 70–71, 62

See application file for complete search history.

(56) References Cited

U.S. PATENT DOCUMENTS 3,475,021 A * 10/1969 Ruegsegger ..... 482/71
3,708,163 A * 1/1973 Hynes ..... 482/71
4,396,189 A * 8/1983 Jenkins ..... 482/71
4,781,372 A * 11/1988 McCormack ..... 482/70
4,909,503 A * 3/1990 Olson ..... 482/71
5,336,141 A * 8/1994 Vittone ..... 482/51
5,391,130 A * 2/1995 Green et al. ..... 482/71
5,967,944 A * 10/1999 Vittone et al. ..... 482/52
6,231,484 B1 * 5/2001 Gordon ..... 482/71
6,234,935 B1 * 5/2001 Chu ..... 482/51
6,277,055 B1 * 8/2001 Birrell et al. ..... 482/52
7,033,306 B2 * 4/2006 Graber ..... 482/57

* cited by examiner

*Primary Examiner*—Steve R Crow

(57) ABSTRACT

An elliptical exerciser includes two side tubes on two sides of the base and two guiding rails are pivotably connected to the two side tubes respectively. Two connection rods are connected to two ends of the crank on the wheel and each connection rod has a roller which is movably engaged with one of the guiding rails. Two pedals are connected to the two connection rods. The angle between the two guiding rails can be adjusted so that the users may operate the elliptical exerciser in a skiing or twisting way.

12 Claims, 8 Drawing Sheets

ELLIPTICAL EXERCISER WITH ADJUSTABLE GUIDING RAILS

FIELD OF THE INVENTION

The present invention relates to an elliptical exerciser wherein the guiding rails along which the pedals are moved can be adjusted to simulate twisting or skiing actions.

BACKGROUND OF THE INVENTION

A conventional elliptical exerciser includes two pedals which have two respective first end connected to a crank of a wheel and the other end of each pedal are movably connected to a rail. By the rotation of the wheel, the pedals are operated in an elliptical trace. It is noted that each of the pedals can only be moved in a vertical plane if viewed form a top of the elliptical exerciser and this makes the users feel boring after a period of operation.

The present invention intends to provide an elliptical exerciser wherein the guiding rails each have an end pivotably connected to two side tubes on the base so that the angle between the two guiding rails can be adjusted to perform different types of actions for the users.

SUMMARY OF THE INVENTION

The present invention relates to an elliptical exerciser which comprises a base with a post and a handlebar is connected to the post. A wheel with a crank and two connection rods are pivotably connected to the two ends of the crank. Two side tubes extend from two sides of the base and two guiding rails are pivotably connected to the two side tubes. Each connection rod has a roller which is movably engaged with one of the two guiding rails. Each connection rod has a pedal connected thereto.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
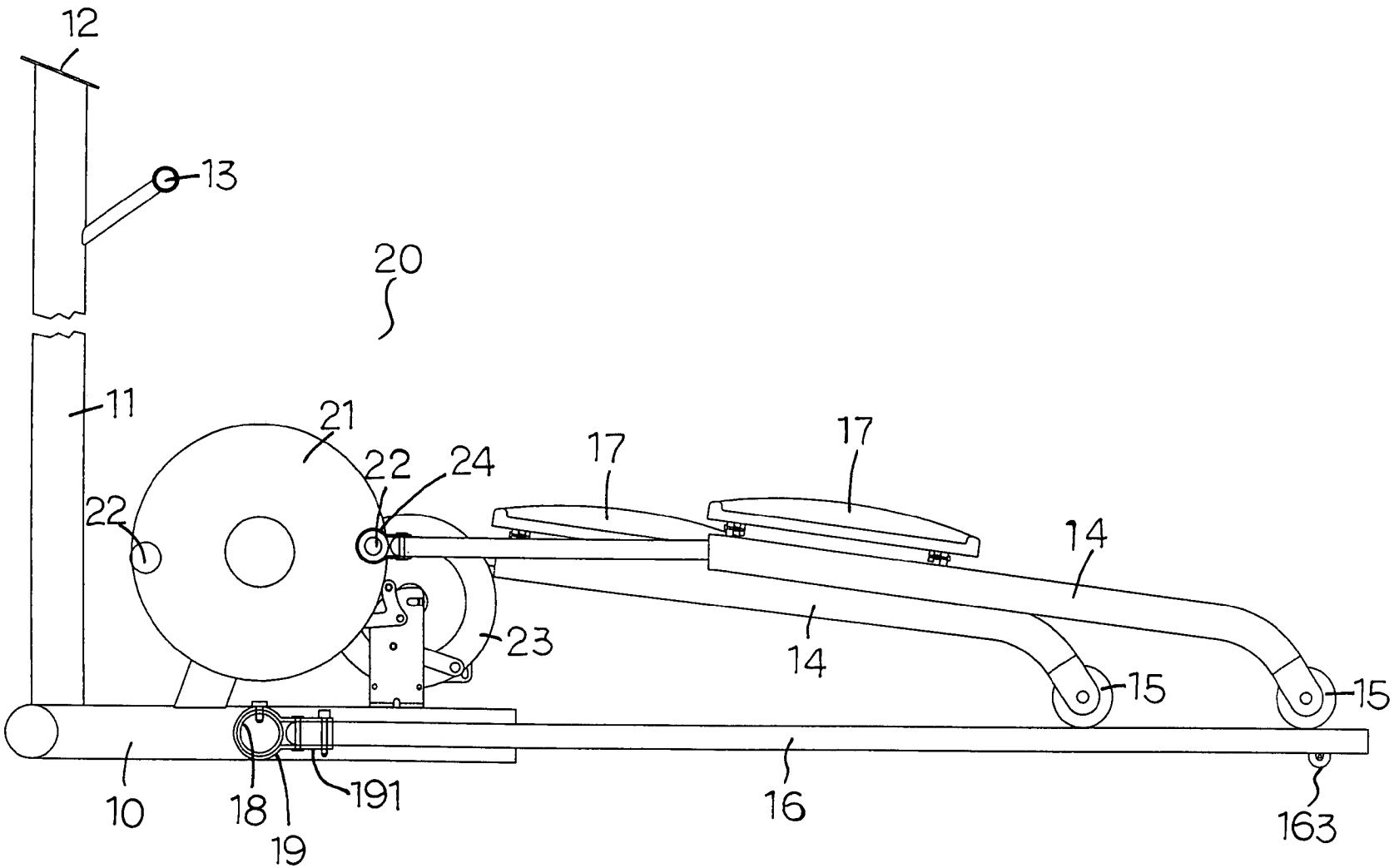
FIG. 1 is a side view to show the elliptical exerciser of the present invention.
Figure 2:
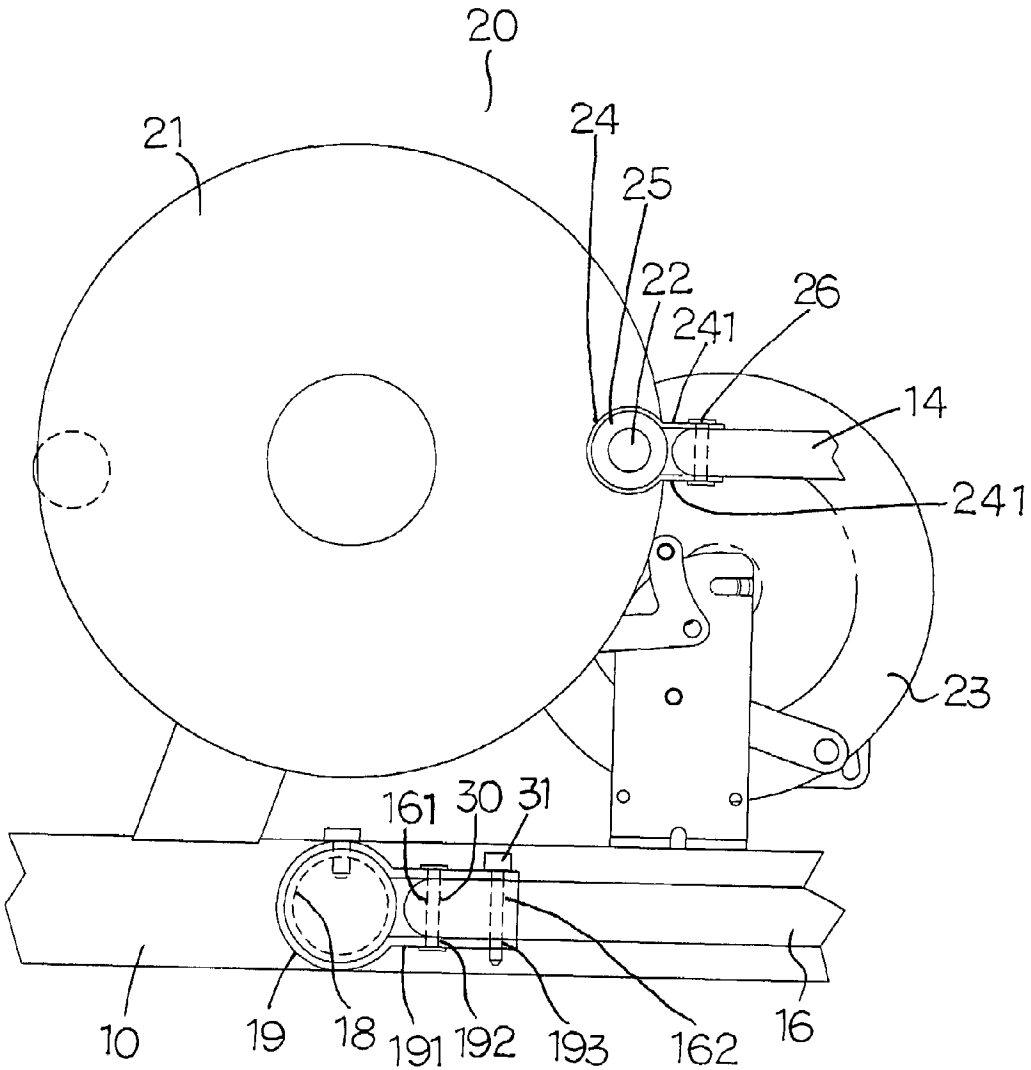
FIG. 2 shows the connection of the connection rod with the crank and the guiding rail with the side tube.
Figure 3:
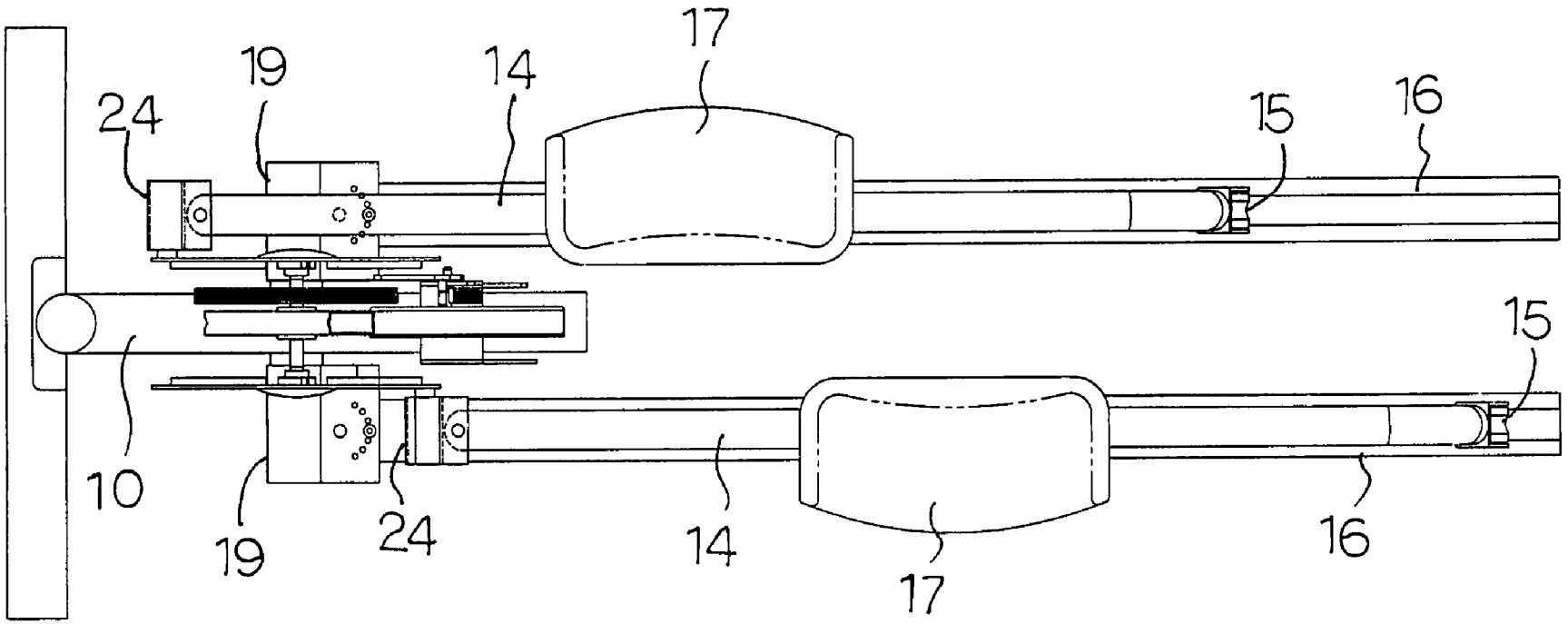
FIG. 3 is a top view to show that the two guiding rails are parallel with each other.

Referring to FIGS. 1 to 3, the elliptical exerciser of the present invention comprises a base 10 with a post 11 and a handlebar 13 is connected to the post 11. A display unit 12 is connected on a top of the post 11 so as to provide physical information of the users and the status of the exerciser.

A transmission device 20 is connected to the base 10 and includes a wheel 21 and a crank 22 is connected to the wheel 21. A resistance unit 23 is located beside the wheel 21 to generate resistance when the wheel 21 is rotated by the users. Two connection rods 14 each have a first end pivotably connected to one of the two ends of the crank 22 and a second end of each connection rod 14 having a roller 15. Two side tubes 18 extend from two sides of the base 10 and two guiding rails 16 have two respective first ends respectively and pivotably connected to the two side tubes 18. The rollers 15 are movably engaged with the two guiding rails 16 and each connection rod 14 has a pedal 17 connected thereto. A caster 163 is connected to an underside of a second end of each of the guiding rails 16 so as to easily adjust the rails 16. Two first U-shaped connection members 24 and two bearings 25 are connected to the two ends of the crank 22 and each first U-shaped connection member 24 includes two extensions 241. The first end of each of the two connection rods 14 is pivotably connected between the two extensions 241 by a pin 26.

Figure 4:
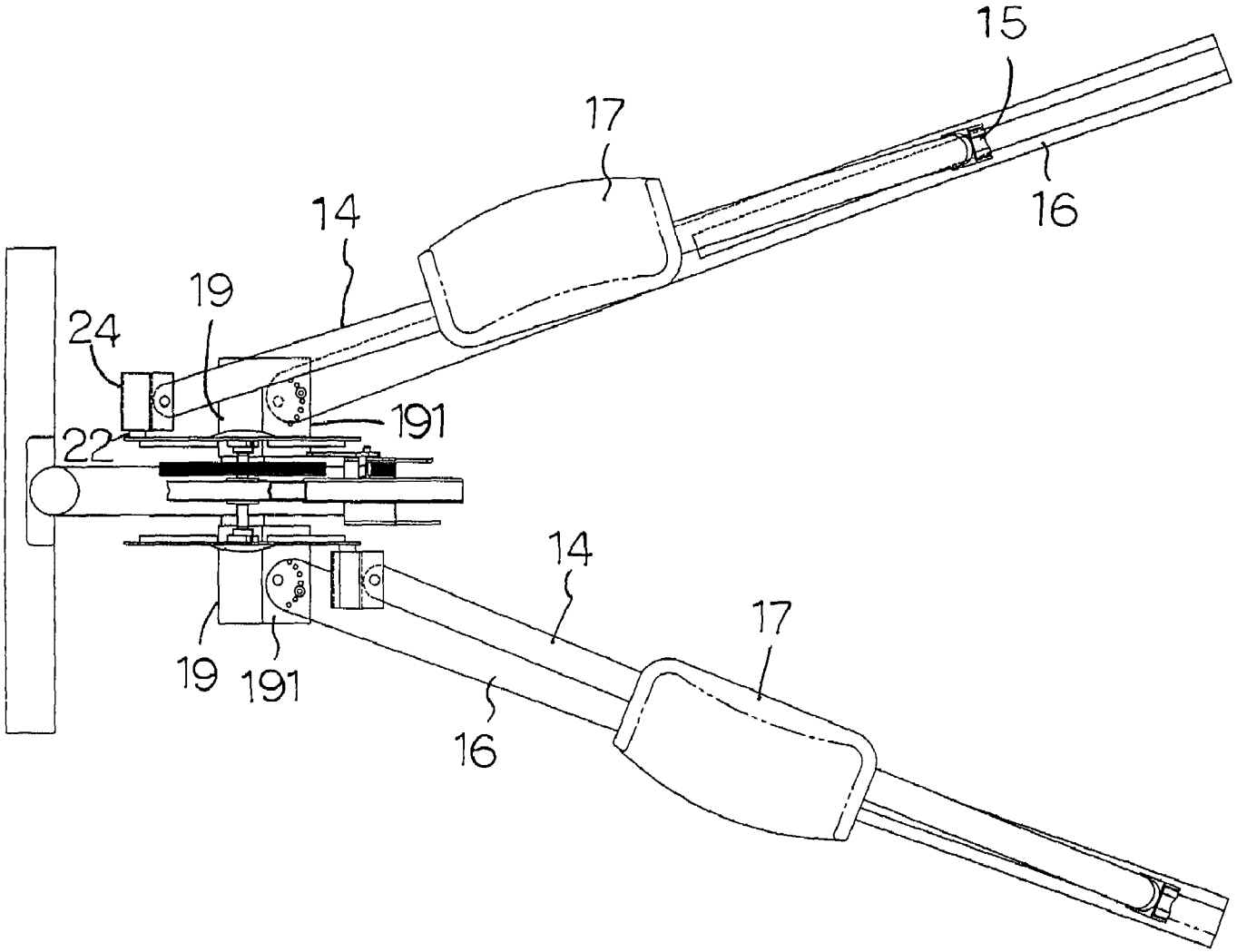
FIG. 4 is a top view to show that the two guiding rails are opened wide.
Figure 5:
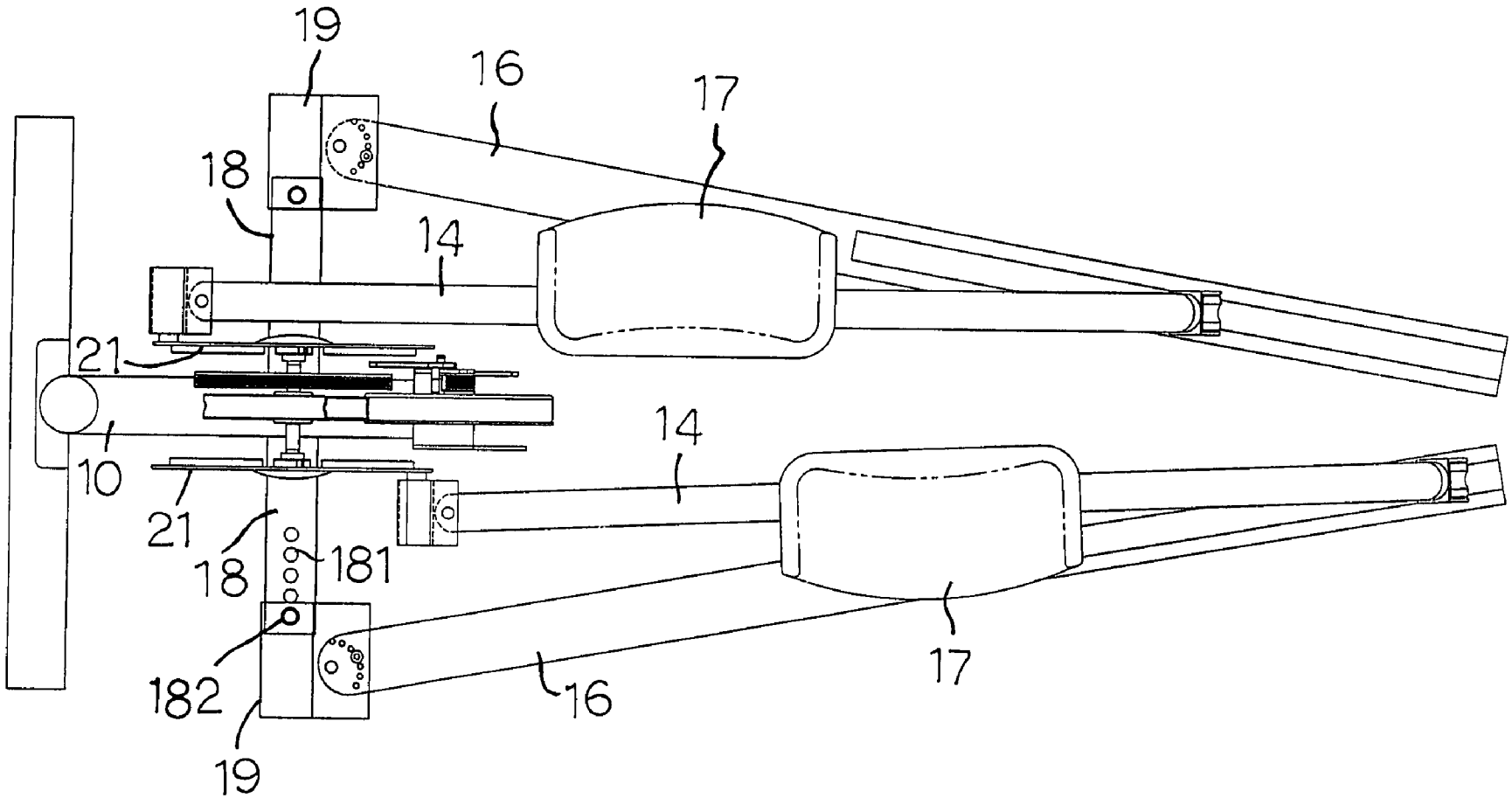
FIG. 5 is a top view to show that the two guiding rails are slidably connected to the side tubes and can be narrowed at two respective ends thereof.

Two second U-shaped connection members 19 are respectively mounted to the two side tubes 18 and each second U-shaped member 19 has two extensions 191 between which the first end of the guiding rail 16 is pivotably connected by a pin 30 which extends through holes 192 in the two extensions 191 and a hole 161 in the guiding rail 16. Each of the two extensions 191 further includes a plurality of first holes 193 and a second hole 162 is defined in each of the connection rods 14. A pin 31 extends through one of the first holes 193 and the second hole 162. The first holes 193 are arranged in an arc so that the two rails 16 can be opened wide as shown in FIG. 4 at the second ends thereof or gathered toward each other as shown in FIG. 5.

Figure 7:
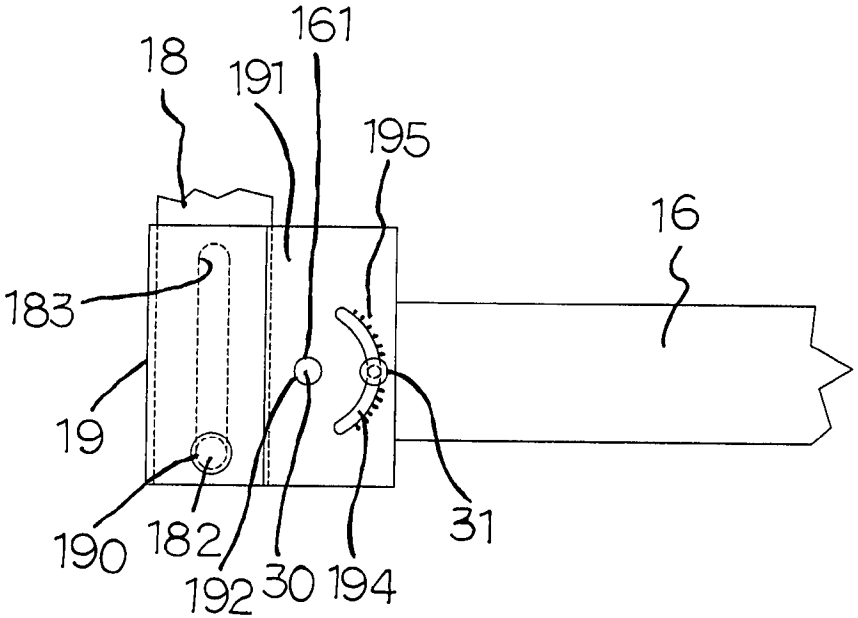
FIG. 7 shows a second embodiment of the connection of the second U-shaped connection member and the side tube.

It is noted that the two guiding rails 16 can also be arranged to parallel with each other as shown in FIG. 3 which is the same as the conventional elliptical exerciser. When the guiding rails 16 are arranged as shown in FIG. 4, the users can operate the exerciser as skating or skiing, and when the guiding rails 16 are arranged as shown in FIG. 5, the users can operate the exerciser as twisting. As shown in FIG. 7, at least two protrusions 141 extend from each of the connection rods 14 each pedal 17 has at least two connection members 171 extending from an underside thereof. A pin extends through the protrusion 141 and is connected to the connection member 171. A spring 32 is mounted to the pin and biased between the protrusion 141 and the connection member 171. This allows the users' feet to be more comfortable during using the elliptical exerciser.

As shown in FIG. 7, each of the two extensions 191 may have a curve slot 194 and a pin 31 extends through the curve slot 194 and the second hole 162. The pin 31 is secured by a nut or any known method. A plurality of index marks 195 are marked on each of the extensions 191 and along the curve slot 194 so that the users know the angle to be set between the two guiding rails 16.

Figure 6:
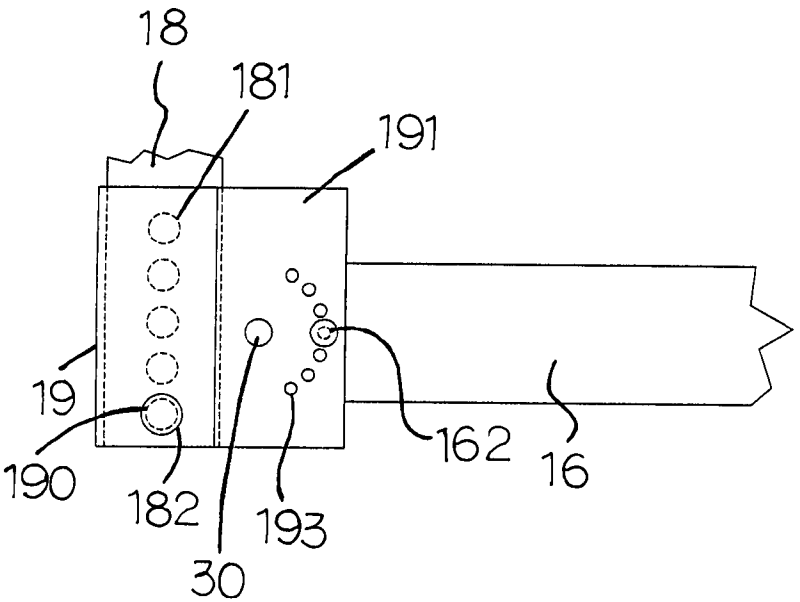
FIG. 6 shows a first embodiment of the connection of the second U-shaped connection member and the side tube.
Figure 8:
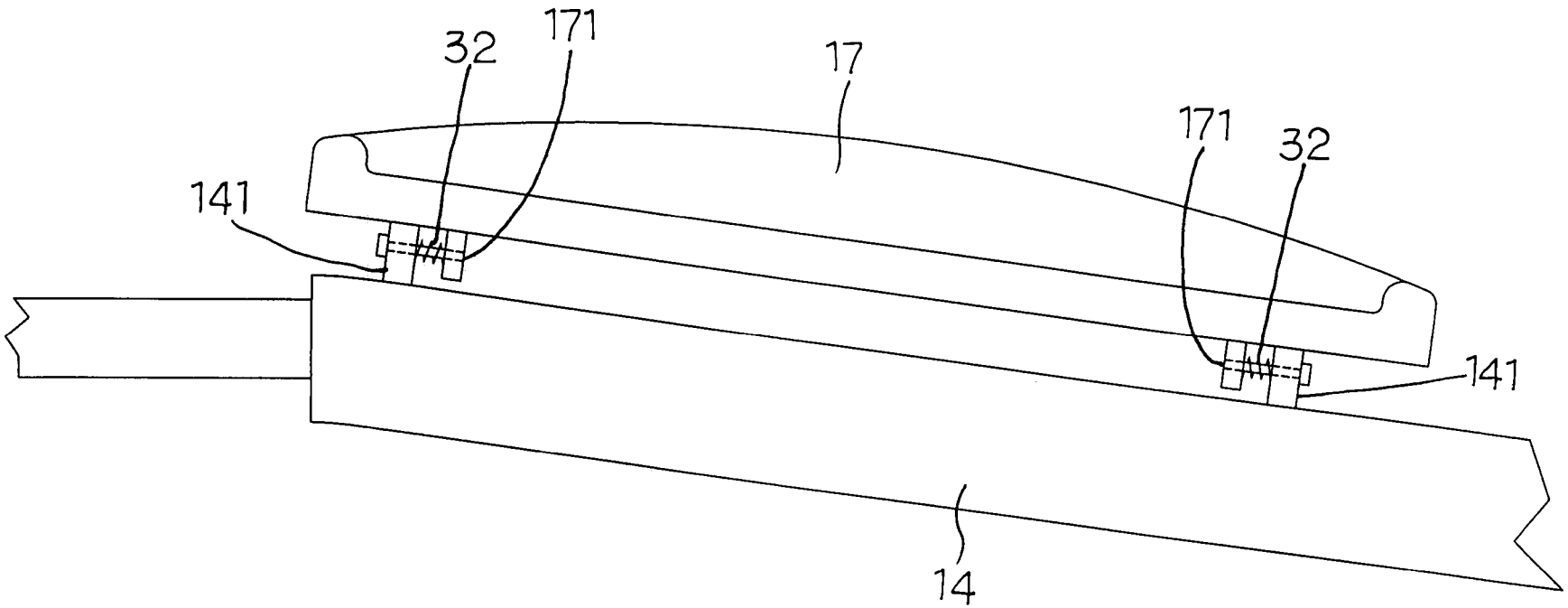
FIG. 8 shows the connection of the pedal and the connection rod.

FIG. 6 shows that the two second U-shaped connection members 19 are slidably mounted to the two side tubes 18 respectively and each side tube 18 has a plurality of positioning holes 181. Each of the second U-shaped members 19 having a through hole 190 and a pin 182 extends through the through hole 190 and one of the positioning holes 181. By this way, the distance of the guiding rails 16 and the wheel 21 can be adjusted as shown in FIG. 5.

Each of the second U-shaped members 19 may also includes an inner threaded section which is threadedly mounted to an outer threaded section of the side tube 18. The second U-shaped members 19 can be moved relative to the side tube 18 by using a motor or chain transmission, both of which are not shown.

In FIG. 7, each side tube 18 may have a straight groove 183 and a pin 182 extends through the through hole 190 and is engaged with the groove 183. The adjustment allows the users to set the elliptical exerciser to meet individual needs.

Figure 9:
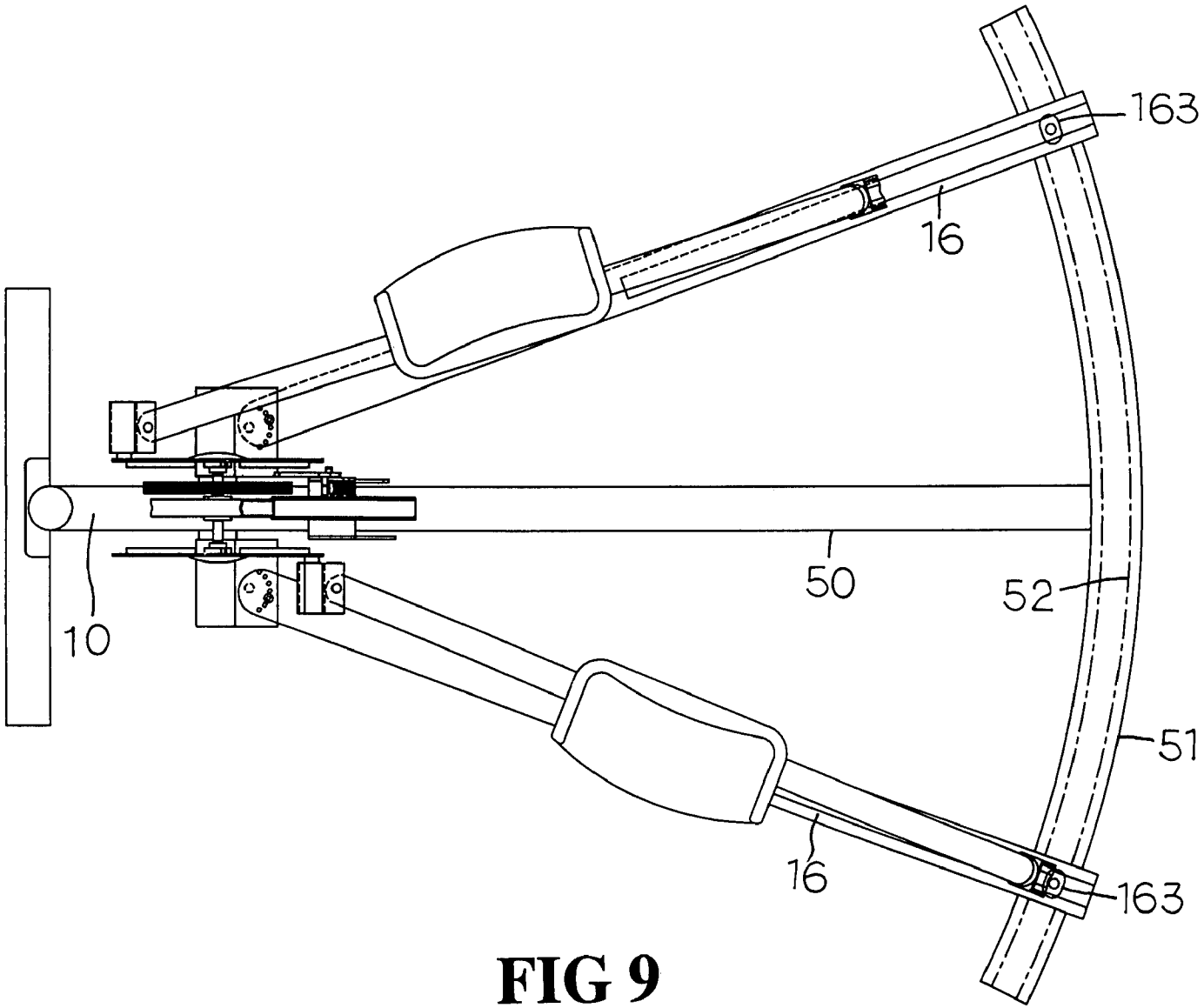
FIG. 9 shows a top view of another embodiment of the present invention.

FIG. 9 shows that a T-shaped frame 50 is connected to the exerciser and a curve track 51 is connected to the T-shaped frame 50. The two guiding rails 16 have two rollers 163 which are moved along a groove 52 in the curve track 51.

While we have shown and described the embodiment in accordance with the present invention, it should be clear to those skilled in the art that further embodiments may be made without departing from the scope of the present invention.

What is claimed is:

1. An elliptical exerciser comprising:

a base (10) with a post (11) and a handlebar (13) connected to the post (11);

a transmission device (20) including a wheel (21) and a crank (22) connected to the wheel (21), two side tubes (18) extending from two sides of the base (10) and two guiding rails (16) having two respective first ends respectively and pivotably connected to the two side tubes (18), and two connection rods (14) each having a first end pivotably connected to one of the two ends of the crank (22) and a second end of each connection rod (14) having a roller (15) which is movably engaged with one of the two guiding rails (16), each connection rod (14) having a pedal (17) connected thereto.

2. The exerciser as claimed in claim 1, wherein two first U-shaped connection members (24) and two bearings (25) are connected to the two ends of the crank (22) and the first ends of the two connection rods (14) are pivotably connected to the first U-shaped connection members (24) by a pin (26).

3. The exerciser as claimed in claim 1, wherein two second U-shaped connection members (19) are respectively mounted to the two side tubes (18) and each second U-shaped member (19) has two extensions (191) between which the first end of the guiding rail (16) is pivotably connected.

4. The exerciser as claimed in claim 3, wherein each of the two extensions (191) includes a plurality of first holes (193) and a second hole (162) is defined in each of the connection rods (14), a pin (31) extending through one of the first holes (193) and the second hole (162).

5. The exerciser as claimed in claim 4, wherein the first holes (193) are arranged to be an arc.

6. The exerciser as claimed in claim 3, wherein each of the two extensions (191) includes a curve slot (194) and a second hole (162) is defined in each of the connection rods (14), a pin (31) extending through the curve slot (194) and the second hole (162).

7. The exerciser as claimed in claim 6, wherein a plurality of index marks (195) are marked on each of the extensions (191) and along the curve slot (194).

8. The exerciser as claimed in claim 3, wherein the two second U-shaped connection members (19) are slidably mounted to the two side tubes (18) respectively and each side tube (18) has a plurality of positioning holes (181), each of the second U-shaped member (19) having a through hole (190) and a pin (182) extending through the through hole (190) and one of the positioning holes (181).

9. The exerciser as claimed in claim 3, wherein the two second U-shaped connection members (19) are slidably mounted to the two side tubes (18) respectively and each side tube (183 has a groove (183), each of the second U-shaped member (19) having a through hole (190) and a pin (182) extending through the through hole (190) and engaged with the groove (183).

10. The exerciser as claimed in claim 1, wherein a caster (163) is connected to an underside of a second end of each of the guiding rails (16).

11. The exerciser as claimed in claim 1, wherein two protrusions (141) extend from each of the connection rods (14) and each pedal (17) has two connection members (171) extending from an underside thereof, a pin extends through the protrusion (141) and is connected to the connection member (171), a spring (32) is mounted to the pin and biased between the protrusion (141) and the connection member (171).

12. The exerciser as claimed in claim 1, wherein a T-shaped frame (50) is connected to the exerciser and a curve track (51) is connected to the T-shaped frame (50), the two guiding rails (16) have two rollers (163) which are moved along a groove (52) in the curve track (51).

* * * * *